United States Patent [19]

Solomon et al.

[11] 4,444,345

[45] Apr. 24, 1984

[54] RAIL LIFTING AND CUTTING MACHINE

[76] Inventors: Steven P. Solomon, 2949 Harrison, Paducah, Ky. 42001; James L. Dunaway, Grand Chain, Ill. 62941

[21] Appl. No.: 311,657

[22] Filed: Oct. 15, 1981

Related U.S. Application Data

[63] Continuation-in-part of Ser. No. 246,409, Mar. 23, 1981, Pat. No. 4,383,630.

[51] Int. Cl.[3] ..... B26F 3/00

[52] U.S. Cl. ..... 225/96.5; 104/7 R; 225/103

[58] Field of Search ..... 225/96.5, 103, 1, 2; 104/7 R, 2 R

[56] References Cited

U.S. PATENT DOCUMENTS

| | | | |
|---|---|---|---|
| 518,416 | 4/1894 | Miller et al. | 225/103 |
| 1,284,312 | 11/1918 | Glover | 225/103 |
| 1,430,916 | 10/1922 | Mason et al. | 104/7 R |
| 2,309,262 | 1/1943 | Thies | 104/7 R |
| 2,334,940 | 11/1943 | LeTourneau | 225/103 |
| 2,354,323 | 7/1944 | Layton | 225/103 X |
| 2,526,362 | 10/1950 | Johnston | 225/103 X |
| 3,924,012 | 12/1975 | Marshall et al. | 225/103 X |
| 4,136,618 | 1/1979 | Boyer | 104/7 R |
| 4,346,828 | 8/1982 | Crawley | 225/96.5 X |

FOREIGN PATENT DOCUMENTS

| | | | |
|---|---|---|---|
| 2939378 | 4/1981 | Fed. Rep. of Germany | 225/96.5 |

*Primary Examiner*—Frank T. Yost

*Attorney, Agent, or Firm*—Emrich & Lee and Brown, Hill, Dithmar, Stotland, Stratman & Levy

[57] ABSTRACT

An apparatus for simultaneously removing and in situ severing of rails from a rail bed to produce a plurality of rail sections of predetermined lengths including a sled frame defining a rail channel with an anvil mounted on the sled frame across the rail channel at the rear thereof. A hammer is mounted on the sled frame above the rail channel spaced from the anvil and moves along a ram path extending from a level above the rail channel to a level below the rail channel. Control mechanism is associated with the hammer for actuating the ram to travel along the ram path to contact a rail and force same against the anvil to cause the rail to fracture. In another embodiment a hammer and blade are carried by a member pivotally mounted on the sled frame sequentially to score the rail and then to sever same.

3 Claims, 9 Drawing Figures

RAIL LIFTING AND CUTTING MACHINE

RELATED APPLICATION

This is a continuation-in-part of our co-pending application Ser. No. 246,409, filed Mar. 23, 1981 for RAIL LIFTING AND CUTTING MACHINE, now U.S. Pat. No. 4,383,630.

BACKGROUND OF THE INVENTION

The present invention relates to machines or apparatus for simultaneously removing and in situ severing of rails from a rail bed to produce a plurality of rail sections of predetermined lengths. It is often desirable, as railway routes are discontinued to recover the rails for later sale. Presently, it is common practice to pry the rails from the railway bed and theredfter transport the rails by truck or the like to a suitable site where they are cut into pieces of convenient lengths, such as one foot or so. As may be imagined, this entails additional time, transportation and handling as compared to a system wherein the rails may be pried and severed in situ to the appropriate lengths and shipped to the final destination directly from the railroad right-of-way.

Prior art devices which are pertinent are illustrated in U.S. Pat. No. 1,430,916 issued to Mason et al. Oct. 3, 1922 for Machine For Removing Rails and Extracting Spikes, U.S. Pat. No. 2,309,262 issued Jan. 26, 1943 to Thies for Apparatus For A Method Of Removing Abandoned Street Car Tracks and U.S. Pat. No. 4,136,618 issued Jan. 30, 1979 to Boyer for Railroad Lifting Device For Ballast Cleaning and Levelling Machines. These patents, while pertinent, do not show or suggest a machine or apparatus for simultaneously removing and in situ severing of rails from a rail bed.

SUMMARY OF THE INVENTION

This invention relates to an apparatus or machine for simultaneously removing and in situ severing of railroad rails from a rail bed to produce rail sections to predetermined lengths.

An important object of the present invention is to provide apparatus for simultaneously removing and in situ severing of rails from a rail bed to produce a plurality of rail sections of predetermined lengths comprising a sled frame defining a rail channel, an anvil mounted on the sled frame across the rail channel at the rear thereof, hammer means mounted on the sled frame above the rail channel spaced from the anvil, means defining a hammer path from a level above the rail channel to a level below the rail channel, and control mechanism associated with the hammer means for actuating the hammer to travel along the hammer path to contact a rail and force same against the anvil to cause the rail to fracture, continued movement of the sled frame along the rail bed and continued operation of the hammer means causing the rails to be lifted from the rail bed and to be cut into predetermined lengths.

Another object of the present invention is to provide an apparatus of the type set forth wherein the rail channel has a bottom plate extending forwardly and downwardly beyond the sled frame to facilitate the passage of the rail into the channel.

Yet another object of the present invention is to provide an apparatus of the type set forth in which the hammer means includes a hydraulic cylinder pivotally mounted to the sled frame.

Still another object of the present invention is to provide an apparatus of the type set forth in which the hammer path is defined by a pair of registered slots in the sled frame, the slots being inclined away from the vertical to ensure that the hammer remains in perpendicular relation to the rail as it bends same around the block.

Still another object of the present invention is to provide an apparatus for simultaneously removing and in situ severing of rails from a rail bed to produce a plurality of rail sections of predetermined lengths comprising a sled frame defining a rail channel having upper and lower plates, an anvil mounted on the sled frame across the rail channel, hammer and blade means mounted on the sled frame movable between a first position wherein the blade means is driven into the top surface of a rail positioned in the rail channel to score and weaken the rail and a second position wherein the hammer means is driven onto the rail to the rear of the anvil to force the rail into contact with the rail channel upper plate and thereafter to sever the rail, and control mechanism associated with the hammer and blade means for actuating the hammer and blade means sequentially into the first and second positions thereof, continued movement of the sled frame along the rail bed and continued operation of the hammer and blade means causing the rails to be lifted from the rail bed and scored and severed into predetermined lengths.

These and other objects of the present invention may be more readily understood when taken in conjunction with the accompanying specification and drawings, in which:

DESCRIPTION OF THE PREFERRED EMBODIMENTS

Figure 1:
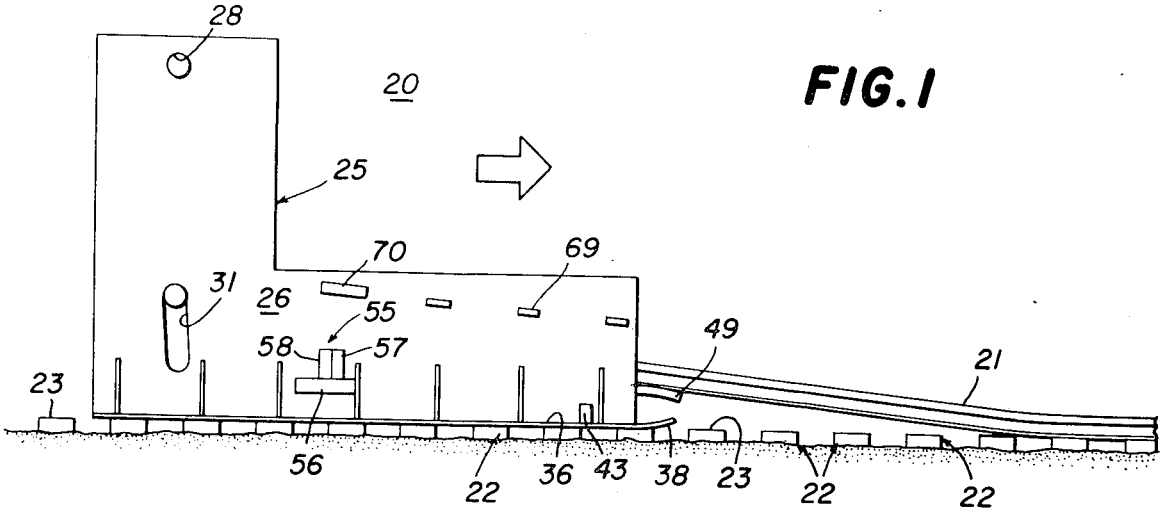
FIG. 1 is a side elevational view of the apparatus of the present invention situated on a railway bed showing a rail in position to be severed.
Figure 2:
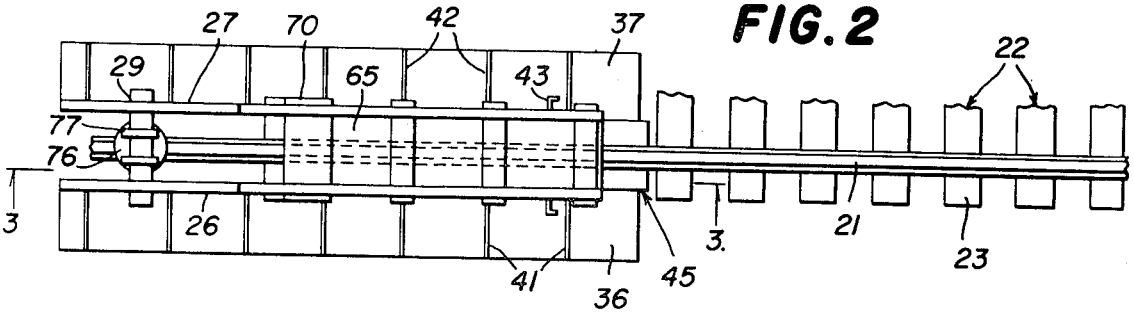
FIG. 2 is a plan view of the apparatus illustrated in FIG. 1.
Figure 5:
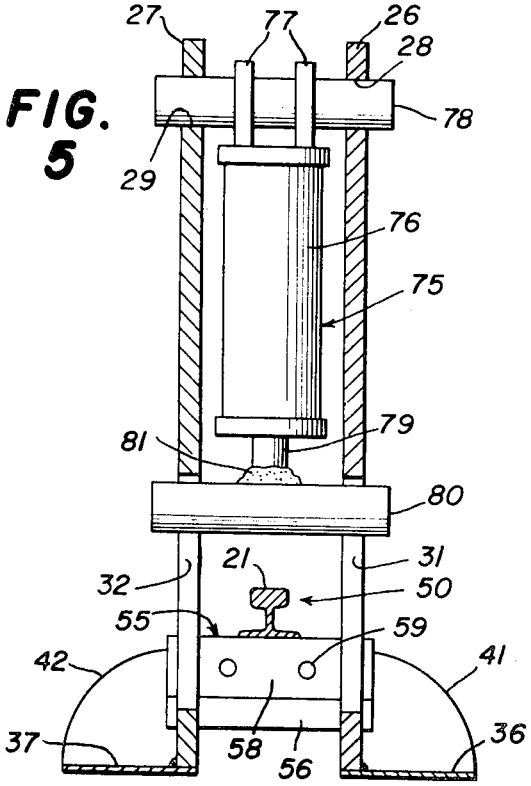
FIG. 5 is a view in section of the apparatus illustrated in FIG. 3 as seen along line 5—5 thereof.

Referring now to the drawings, there is illustrated an apparatus, device or machine 20 for simultaneously removing rails 21 from a railway bed and severing the rails 21 into lengths of predetermined size. The apparatus 20 is adapted to be pulled by means not shown along a railway bed which is comprised of a pair of spaced apart railway rails 21 spiked to a plurality of railway ties 22 each having a top surface 23 thereof on which the rails rest. The apparatus 20 includes a sled 25 which is comprised of spaced apart and parallel side members 26 and 27, respectively provided with apertures 28 and 29 centrally located in the upper portion of each side member. The apertures 28 and 29 are in registry and near the top of the side members 26 and 27, each of which is L-shaped. Each of the side members 25, 26 is respectively provided with a generally vertically extending slot 31 and 32. For reasons hereinafter set forth each of the slots 31, 32 is positioned approximately 3° from the vertical with the bottom of the slot being closer to the front of the sled 25 and the top of the slot being closer to the rear of the sled.

A foot plate 36 is fixedly secured as by welds to the side plate 26 and a foot plate 37 is fixedly secured as by welds to the side plate 27, each of the foot plates 36, 37 being adapted to slide along the top surfaces 23 of the railroad ties during movement of the sled 25 therealong. Each of the foot plates 36, 37 is respectively provided with an upturned end 38,39 to ensure that the sled 25 rides smoothly on the ties 22 and does not catch or jam against a tie 22 which may be elevated with respect to the railway right-of-way or bed.

A plurality of brace members 41, 42 are longitudinally spaced apart along the sled 25 respectively bracing side member 26 to foot plate 36 and side member 27 to foot plate 37. Each of the brace members 41, 42 is pie-shaped and extends through approximately 90° of arc, the brace members 41 being positioned, as stated, to brace the side member 26 to the foot member 36 and the brace members 42 being positioned to brace the side member 27 to the foot member 37. Each of the brace members 41, 42 is secured as by welds or the like. Finally, near the front of the sled 25 are two angle iron pulls 43 one located on each of the side plates 26 and 27 to facilitate the pulling of the sled 25 in the direction of the arrow in FIG. 1 by a tractor or the like.

Figure 6:
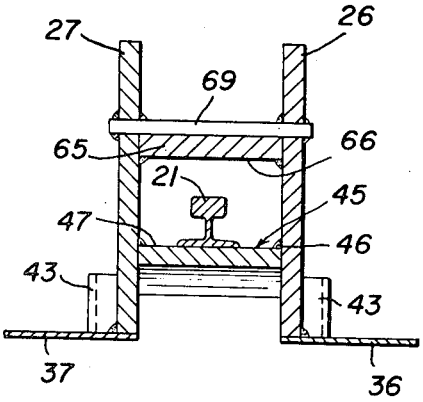
FIG. 6 is a view in section of the apparatus illustrated in FIG. 3 as seen along line 6—6 thereof.
Figure 4:
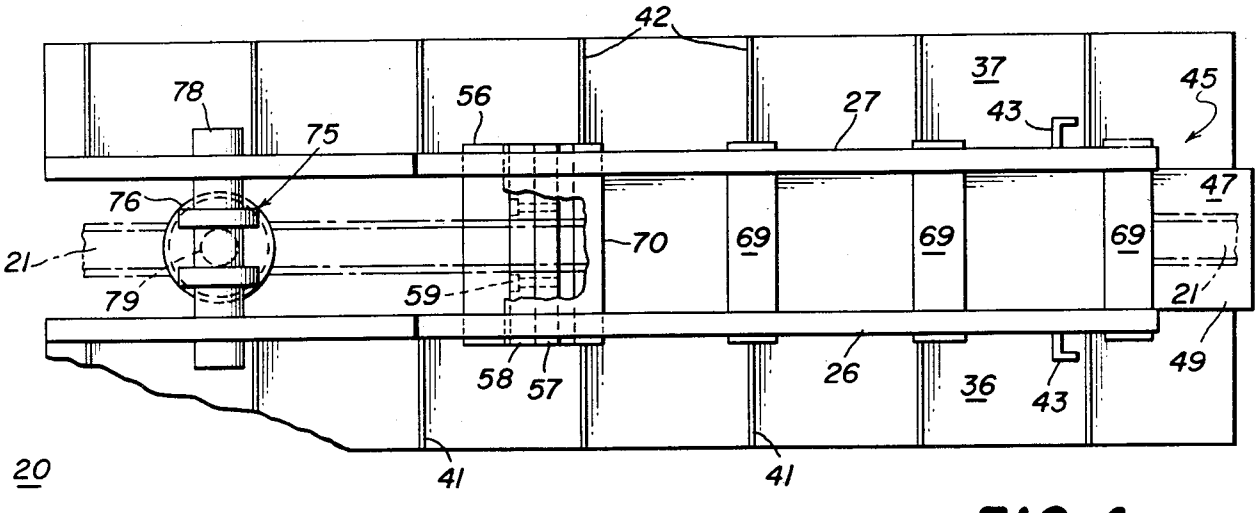
FIG. 4 is an enlarged plan view of the apparatus illustrated in FIG. 3.

A rail channel 50 through which the rail 21 is transported is defined by the side members 26, 27 and a bottom rail channel plate 45 fixedly secured to the side members 26, 27 as by welds 46, see FIG. 6. The bottom rail channel plate 45 has an upper support surface 47 and terminates at a rear edge 48 and has a downwardly sloping front portion 49 extending beyond the forward end of the side members 26, 27. Rearward of the rear edge 48 of the bottom rail channel plate 45 is an anvil 55. The anvil 55 is mounted on a support plate 56 which extends between and is welded to the side members 26, 27. The anvil 55 includes a stationary member 57 forwardly positioned on the support plate 56 and a replaceable nember 58 secured to the stationary member by means of two spaced apart fasteners 59. The replaceable member 58 is preferably of hardened steel and is easily replaced.

The rail channel 50 is further defined by a top rail channel plate 65 having a bottom abutment surface 66 and a front edge 67 which is generally in registry with the front end of the side members 26, 27 and a rear edge 68 which extends beyond the rear edge 48 of the bottom rail channel plate 45. The top rail channel plate 65 is fixedly secured to a plurality of longitudinally spaced apart cross bars 69 each appropriately secured to the respective side members 26, 27. The rear cross bar 70 is larger than the other cross bars 69 and is also secured to the side members 26, 27 as well as to the top rail channel plate 65. As may be noted, both the bottom channel plate 45 and the top channel plate 65 extends forwardly and downwardly to define an inclined or slanted rail channel 50.

The apparatus 20 is further provided with hammer means 75 in the form of a hydraulic cylinder 76 supported on the side members 26, 27 by means of a support rod 78 extending through a clevis 77 at the top of the cylinder. The cylinder 76 has a piston 79 at the bottom thereof which is suitably secured to a cylindrical ram 80 by means of welds 81. The cylindrical ram 80 is positioned in the slots 31 and 32 thereby to move along a ram path defined by the slots, the slots being spaced from the vertical 3° as previously disclosed. The cylindrical ram 80 is free to move along the slots 31, 32 due to the pivotal mounting of the hammer means 75 to the side members 26, 27, which pivotal mounting also facilitates easy servicing of the hammer means 75.

Finally, control mechanism 85 is connected to the hydraulic cylinder 76 by means of inlet and outlet hydraulic lines 86, 87, the cylindrical ram 80 moving downwardly along the slots 31, 32 in response to actuation of the control mechanism 85, which control mechanism may be carried by the pulling vehicle (not shown) or mounted on one of the side members 26, 27.

In use, the apparatus 20 is positioned on a railway bed and one end of a rail 21 is manually pried from the ties 22 and inserted into the rail channel 50 and particularly into the forward end thereof defined by the downwardly sloping portion 49 of the bottom rail channel plate 45. Thereafter, movement of the apparatus 20 and particularly the sled 25 in the direction of the arrow in FIG. 1 causes the rail 21 which is resting on the support surface 47 to move rearwardly toward the hammer means 75. Continued movement of the sled 25 in the direction of the arrow causes the sled 25 and the rail 21 to reach the position illustrated in FIG. 3 wherein a predetermined length of rail 21 is behind the anvil 55.

Actuation of the hammer means 75 by operation of the control mechanism 85 causes the cylindrical ram 80 to move downwardly along the slots 31, 32 to contact the top of the rail 21 and to move same downwardly. Although the sled 25 and each of the component parts thereof may be made from regular carbon steel, it is preferred that the anvil 55 and most particularly the replaceable member 58 be made from hardened steel such as tool steel to accommodate the wear and tear due to the action of the ram 80 which causes the rail 21 to bend across the corner of the member 58. The hammer means 75 preferably includes a 65 ton ram with a 14 inch stroke, the cylindrical ram 80 being a 4 inch diameter rod. In use, the cylindrical ram 80 contacts the rail 21 approximately 1 foot to the rear of the anvil 55 thereby causing the rail 21 to bend around the corner of the anvil 55 and more particularly around the corner or upper rear edge of the member 59 and to snap off or be severed from the remainder of the rail 21. The rail 21 is maintained in the rail channel 50 by means of the top plate 65 and particularly the bottom abutment surface 66 thereof, it being apparent that movement of the ram 80 from the retracted position thereof to the fully extending position thereof causes the rail 21 to move upward in the rail channel 50 and contact the top rail channel plate 65.

Figure 3:
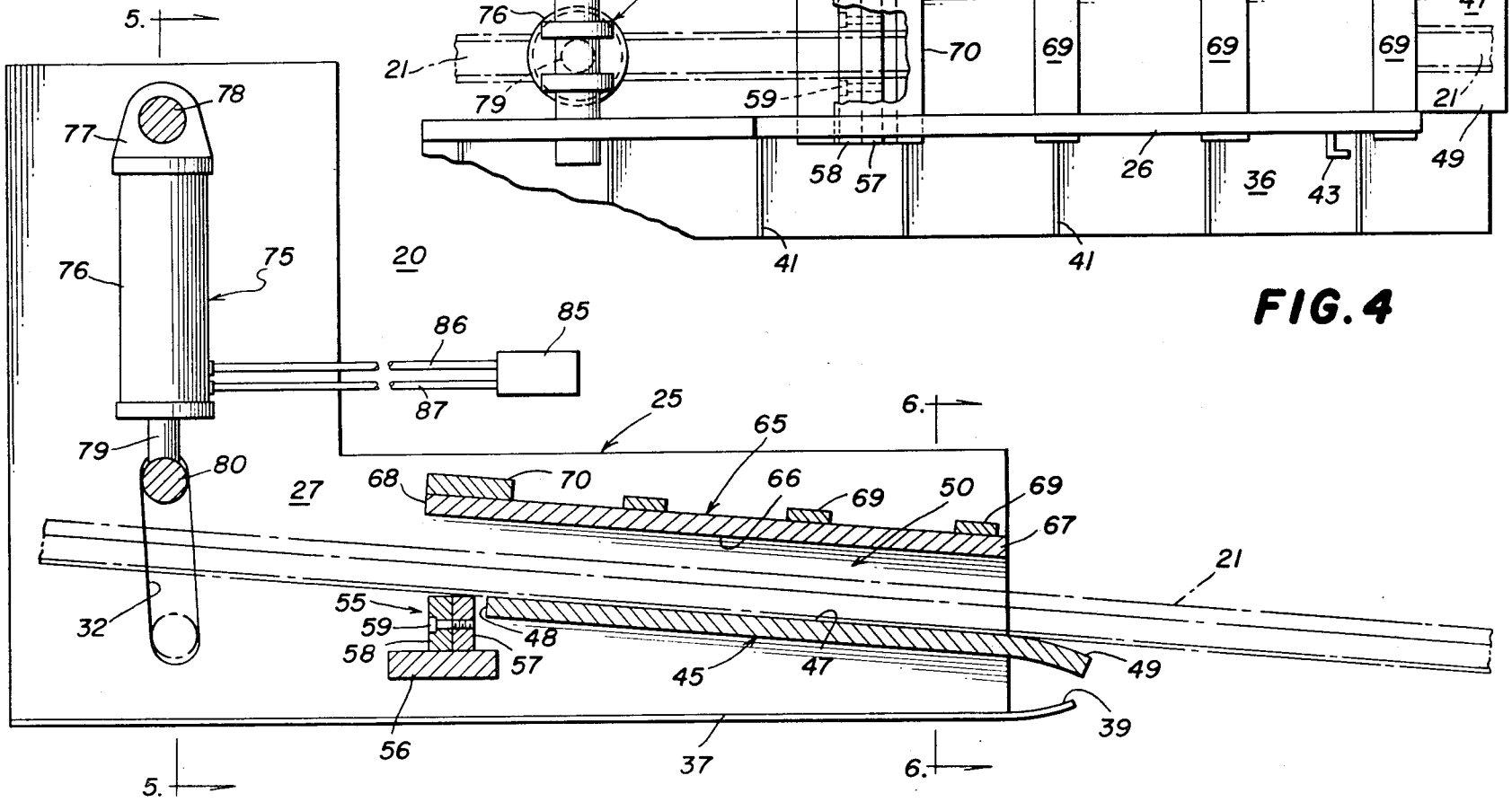
FIG. 3 is a view in section of the apparatus illustrated in FIG. 2 as seen along lines 3—3 thereof.

After the stroke of the hammer means 75 has been completed, and the rail section severed, the cylindrical ram 80 automatically moves to the top of the slots 31, 32 and continued movement of the sled 25 in the direction of the arrow in FIG. 1 causes the rail 21 to again assume the position illustrated in FIG. 3, whereupon actuation of the hammer means 75 by operation of the control mechanism 85 causes another section of the rail 21 to be severed.

The cooperation of the curved surface of the ram 80 and the positioning of the ram path defined by the slots 31, 32 serve to maintain the ram essentially perpendicular to the rail 21 throughout the initial bending and final serving of the rail. This is an important feature of the present invention.

Figures 7, 8, 9:
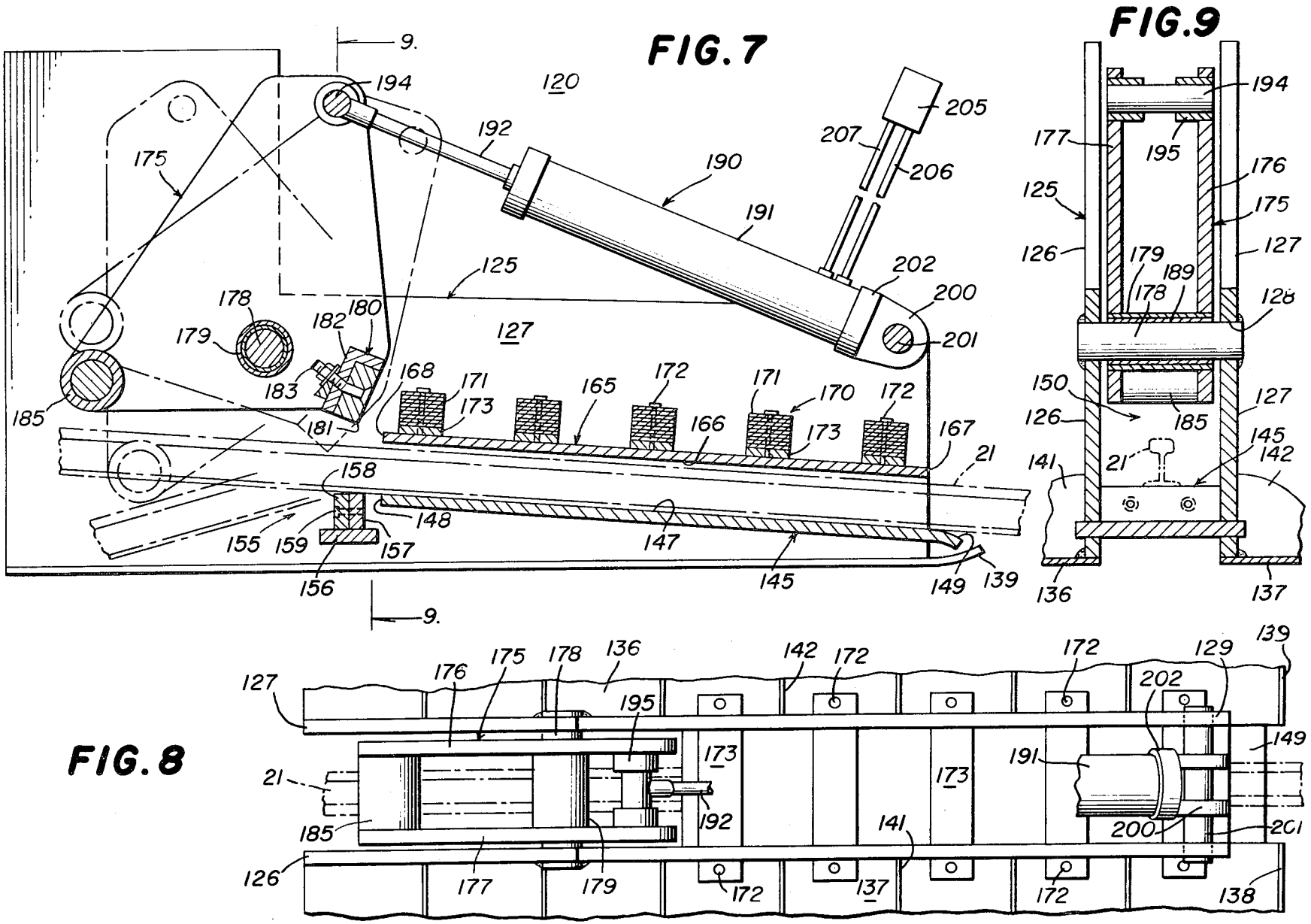
FIG. 7 is a view like FIG. 3 of another embodiment of the present invention illustrating a new hammer and blade mechanism.
FIG. 8 is an enlarged plan view of the apparatus illustrated in FIG. 7.
FIG. 9 is a view in section of the apparatus illustrated in FIG. 7 as seen along line 9—9 thereof.

Referring now to FIGS. 7–9 of the drawings, there is illustrated a second embodiment 120 of the apparatus previously discussed, which embodiment includes a sled 125 having spaced apart parallel L-shaped side frame members 126 and 127, each of the frame members being provided with registered apertures 128 near the leg of the L-shaped frame members and 129 near the upper front end of the frame members.

The sled 125 is provided with spaced apart foot plates 136 and 137 each connected by suitable welds respectively to the sled side frame members 126 and 127. The foot plates 136, 137 are adapted to slide along the top surfaces 23 of the railroad ties 22 during movement of the sled 125 therealong. Each of the foot plates 136, 137 is respectively provided with an upturned end 138, 139, respectively to facilitate the sliding action of the sled 125 along the top surfaces 23 of the railroad ties 22. Bracing members 141 and 142 of the same geometry and configuration as the bracing members 41 and 42 previously disclosed serve to strengthen the sled 125.

A rail channel 150 through which the rail 21 is transported is defined by side frame members 126, 127 and a bottom rail channel plate 145 fixedly secured to the side members 126, 127 as by welds. The bottom rail channel plate 145 has an upper support surface 147, a rear edge 148 and a downwardly sloping front portion 149 extending beyond the forward end of the side frame members 126, 127. Rearwardly of the rear edge 148 of the bottom rail channel plate 145 is an anvil 155 mounted on a support plate 156 which extends between and is welded to the side members 126, 127. The anvil 155 includes a stationary member 157 forwardly positioned on the support plate 156 and a replaceable member 158 secured to the stationary member by means of two spaced apart fasteners 159. The replaceable member 158 is preferably of hardened steel and is replaced as needed.

The rail channel 150 is further defined by a rail channel upper plate 165 having a bottom abutment surface 166, a front edge or end 167 which generally is in registry with the front end of the side members 126, 127 and a rear end or edge 168 which generally is in vertical registry with the end 148 of the bottom plate 145. The rail channel upper plate 165 is fixedly secured to a plurality of longitudinally spaced apart cross bars 173 each of which is mounted in a shim assembly 170. Each shim assembly 170 includes a generally rectangular opening in the appropriate side frame members 126,127 which houses a plurality of shims 171 which in cooperation with the associated cross plates 173 and an associated fastener 172 permits vertical adjustment of the rail channel upper plate 165 in rapid fashion to accommodate rails 21 of different heights and weight.

The adjustable feature of the rail channel upper plate 165 is an important improvement in the invention because it has been found that it is preferred to have the bottom surface 166 of the rail channel upper plate 165 no more than about one-half inch above the top of the associated rail 21 thereby to perform the severing in a more rapid and easier manner.

A hammer and blade means 175 in the form of a pair of triangular plates 176,177 is pivotally mounted to the sled 125 by means of a shaft 178 extending through apertures 128 and welded to the side frame members 126, 127. The shaft 178 is provided with a bushing and blade means 175, thereby to provide pivotal movement of the hammer and blade means between the first and second positions thereof, as will be explained.

The blade assembly 180 is carried by the hammer and blade means 175 more specifically is between the parallel plates 176 and 177 thereof. The blade assembly 180 includes a stationary holder 182 and a removable piece of hardened steel 181 carrying a cutting edge thereon. The hardened steel 181 is mounted to the holder 182 by means of a fastener arrangement 183. The hardened steel 181 is therefore easily removable and replaceable when the cutting edge thereof becomes dull or worn. The hammer means 185 is in the form of a cylindrical ram which is mounted between the associated plates 176 and 177 of the hammer and blade means 175.

Motor means 190 is a hydraulic cylinder 191 having an outwardly extending piston 192 connected to the hammer and blade means 175 by means of a connection rod 194 extending between the adjacent members 176, 177, the connection rod 194 being free to pivot in the bushings 195 respectively connected to the side members 176, 177. The motor means 190 is pivotally mounted at the other end thereof to the sled 125, as best seen in FIG. 8, by means of a rod 201 through a clevis portion 200 extending from the end cap 202 of the cylinder 191, the rod 201 extending through the aligned apertures 129 in the side frame members 126, 127. A control mechanism 205 is connected to the motor means 190 via a pair of hydraulic lines 206 and 207, thereby to cause the piston 192 to extend and retract.

Referring now to FIG. 7 of the drawings, there is shown the first and second positions of the hammer and blade means 175. When the piston 192 is fully withdrawn, the hammer and blade means 175 moves to the right (first position) as seen in the drawings to the dotted line position wherein the hardened steel 181 and particularly the cutting edge thereof contacts the rail 21 and is driven thereinto, thereby to score the top of the rail 121 and to weaken same. Thereafter, the control mechanism 205 is operated to cause the piston 192 of the motor means 190 to extend forwardly until the hammer and blade means 175 is moved to the left to the second position thereof wherein the hammer means 85 and particularly the cylindrical ram forces the rail 21 and particularly the portion thereof to the left of the anvil 155 downwardly over the hardened steel portion 158 causing the rail 21 to sever along the score line previously made by the blade mechanism 180. The rocking action of the hammer and blade means 175 between the first and second positions thereof facilitates the severing of the rail 21. The cooperation of the hammer and blade means 175 with the shim assemblies 170 results in a more rapid and easier severing of the rails 21 thereby facilitating the removal and severing of the rails into predetermined lengths.

Accordingly, an apparatus, device or machine has been provided for simultaneously removing and severing in situ rails from a rail bed. All the objects and advantages of the present invention have been attained by the before described preferred embodiments. It will be apparent to those skilled in the art that various modifications and alterations may be made in the foregoing described embodiments without departing from the true spirit and scope of the present invention which is intended to be covered in the claims appended hereto.

What is claimed is:

1. Apparatus for simultaneously removing and in situ severing of rails from a rail bed to produce a plurality of rail sections of predetermined lengths comprising a sled frame defining a rail channel having upper and lower plates, an anvil mounted on said sled frame rearwardly of and across said rail channel, hammer and blade means mounted on said sled frame movable between a first position wherein said blade means is driven into the top surface of a rail positioned in said rail channel to score and weaken the rail and a second position wherein said hammer means is driven onto the rail to the rear of said anvil and said rail channel to force the rail into contact with said rail channel upper plate and thereafter to sever the rail, and control mechanism associated with said hammer and blade means for actuating said hammer and blade means sequentially into the first and second positions thereof, whereby movement of said sled frame along the rail bed and operation of said hammer and blade means causes the rails to be lifted from the rail bed and scored and severed into predetermined lengths.

2. The apparatus of claim 1, wherein said hammer and blade means are carried by a triangularly shaped member pivotally mounted to said sled frame.

3. The apparatus of claim 1, wherein said sled frame has a plurality of longitudinally spaced apart slots above said rail channel, a plurality of shims in each slot to provide quick adjustment of said rail channel upper plate and a plurality of cross support members longitudinally spaced and extending across the top of said rail channel upper plate.

* * * * *